United States Patent [19]

Ozu

[11] Patent Number: 4,476,691

[45] Date of Patent: Oct. 16, 1984

[54] REFRIGERATION CYCLE APPARATUS

[75] Inventor: Masao Ozu, Fuji, Japan

[73] Assignee: Tokyo Shibaura Denki Kabushiki Kaisha, Kawasaki, Japan

[21] Appl. No.: 498,785

[22] Filed: May 27, 1983

[30] Foreign Application Priority Data

Jun. 4, 1982 [JP] Japan ..... 57-96040

[51] Int. Cl.[3] ..... F25B 41/04

[52] U.S. Cl. ..... 62/217; 62/528; 62/504; 137/503

[58] Field of Search ..... 62/217, 504, 527, 528; 137/503, 506

[56] References Cited

U.S. PATENT DOCUMENTS

| | | | |
|---|---|---|---|
| 3,498,183 | 3/1970 | Risk | 137/503 |
| 3,855,836 | 12/1974 | Takahashi et al. | 62/217 |
| 4,129,995 | 12/1978 | Usami | 62/217 |

FOREIGN PATENT DOCUMENTS

| | | |
|---|---|---|
| 52-38774 | 9/1977 | Japan . |
| 887884 | 1/1962 | United Kingdom . |
| 1111536 | 5/1968 | United Kingdom . |

*Primary Examiner*—Ronald C. Capossela
*Attorney, Agent, or Firm*—Cushman, Darby & Cushman

[57] ABSTRACT

A refrigeration cycle apparatus has a compressor, a condenser connected to the discharge side of the compressor, an evaporator connected to the suction side of the compressor, a decompressor connected between the condenser and evaporator, and a valve of a pressure responsive type. The valve includes a housing having a chamber, and a valve piston slidably received in the chamber. The suction side of the compressor is connected to the chamber through a first communication port of the housing and the discharge side of the evaporator is connected to the chamber through a second communication port of the housing. The discharge side of the condenser is connected to the chamber through a first guide port of the housing and the discharge side of the decompressor is connected to the chamber through a second guide port of the housing. The valve piston has a first communication passage for communicating the first and second communication ports, and a second communication passage for communicating the first and second guide ports.

10 Claims, 6 Drawing Figures

REFRIGERATION CYCLE APPARATUS

BACKGROUND OF THE INVENTION

This invention relates to a refrigeration cycle apparatus. A refrigeration cycle apparatus generally comprises a compressor, condenser, electromagnetic valve, capillary tube acting as a decompressing device, evaporator and stop valve all arranged in series. The stop valve is connected to the compressor, thereby assuring a refrigeration cycle. The compressor causes a coolant to circulate through a refrigerating cycle by passing through the above-mentioned members in succession. The coolant is volatilized in the evaporator, and performs refrigeration by absorbing evaporation latent heat from the surrounding region. When the compressor is brought to rest, a signal is issued to close the electromagnetic valve. At this time, a coolant gas in the process of being compressed in the cylinder of the compressor flows back to the suction side of the compressor, that is, the side of the stop valve. However, the stop valve prevents the back-flowing coolant gas from running into the evaporator. Further, the electromagnetic valve which is closed at this time prevents a liquid coolant collected in the condenser from flowing into the evaporator. In other words, when the compressor is at rest, the high and low pressure sides of the evaporator are shut off by the stop valve and electromagnetic valve. As a result, the temperature of the evaporator increases only slightly when the compressor stops, thereby reducing loss of the refrigerating capacity of the refrigeration cycle apparatus when it is started again. The compressor substantially retains the gas pressure prevailing immediately before its stoppage. When started again, therefore, the internal pressure of the compressor quickly rises, thereby assuring the reduction of power consumption.

However, the conventional refrigeration cycle apparatus of the above-mentioned arrangement has the drawbacks as follows. Since the apparatus is necessary to provide an electromagnetic valve and stop valve, piping work is complicated. The electromagnetic valve is relatively expensive and an electric circuit has to be provided for the actuation of the electromagnetic valve. Therefore the refrigeration cycle apparatus is expensive. In addition, a relatively large power consumption is involved.

SUMMARY OF THE INVENTION

This invention has been accomplished in view of the above-mentioned circumstances, and is intended to provide a relatively inexpensive refrigeration cycle apparatus involving a small power consumption.

According to an aspect of the invention, a refrigeration cycle apparatus comprises:

a compressor;

a condenser connected to the discharge side of the compressor;

an evaporator connected to the suction side of the compressor;

a decompressor connected between the condenser and evaporator; and a valve which includes a housing having a chamber communicating with the suction side of the compressor and the discharge side of the evaporator and first and second guide ports open to the interior of the chamber; and a valve piston slidably received in the chamber and provided with a first operation plane receiving the pressure of the suction side of the compressor, a second operation plane receiving the pressure of the discharge side of the evaporator, a first communication passage for effecting communication between the suction side of the compressor and the discharge side of the evaporator and a second communication passage for effecting communication between the first and second guide ports; the valve being so designed that when the suction side of the compressor has a lower pressure than the discharge side of the evaporator, the valve slides to a first position for effecting communication between the suction side of the compressor and the discharge side of the evaporator through the first communication passage and for effecting communication between the first and second guide ports through the second communication passage; and when the suction side of the compressor has a higher pressure than the discharge side of the evaporator, the differential valve slides to a second position for shutting off communication between the suction side of the compressor and the discharge side of the evaporator as well as between the first and second guide ports; and wherein the first and second guide ports are connected between the discharge side of the compressor and the suction side of the evaporator.

A refrigeration cycle apparatus embodying this invention arranged as described above is provided with a valve of a pressure responsive type in place of a stop valve and electromagnetic valve. The valve is provided with a valve piston which slides due to a pressure difference between the suction side of the compressor and the discharge side of the evaporator. When the suction side of the compressor has a higher pressure than the discharge side of the evaporator, that is, when the compressor stands at rest, the valve piston slides to a second position to shut off communication between the suction side of the compressor and the discharge side of the evaporator as well as between the first and second guide ports. For instance, when the discharge side of the condenser is connected to the first guide port, and the suction side of the decompressor is connected to the second guide port, the valve piston slides to the second position, thereby shutting off communication between the discharge side of the condenser and the suction side of the decompressor. Thus, the valve acts both as a stop valve and as an electromagnetic valve. Therefore, the refrigeration cycle apparatus of this invention eliminates the necessity of providing an electromagnetic valve and an electric circuit for actuating said electromagnetic valve, and consequently, can be manufactured at low cost. Further, the valve which requires no power for the operation of the valve piston reduces the power consumption of the subject refrigeration cycle apparatus.

BRIEF DESCRIPTION OF THE DRAWINGS

FIGS. 1 to 4 show a refrigeration cycle apparatus embodying this invention; in which FIG. 1 is a block circuit diagram of a refrigeration cycle undertaken by the subject refrigeration cycle apparatus, FIG. 2 is a longitudinal sectional view of a valve used with the subject refrigeration cycle apparatus, FIG. 3 is an oblique view, partly in section, of the differential valve, FIG. 4 is a longitudinal sectional view of the valve indicating a different operating condition from that of FIG. 2.

DETAILED DESCRIPTION OF THE PREFERRED EMBODIMENT

Figure 1:
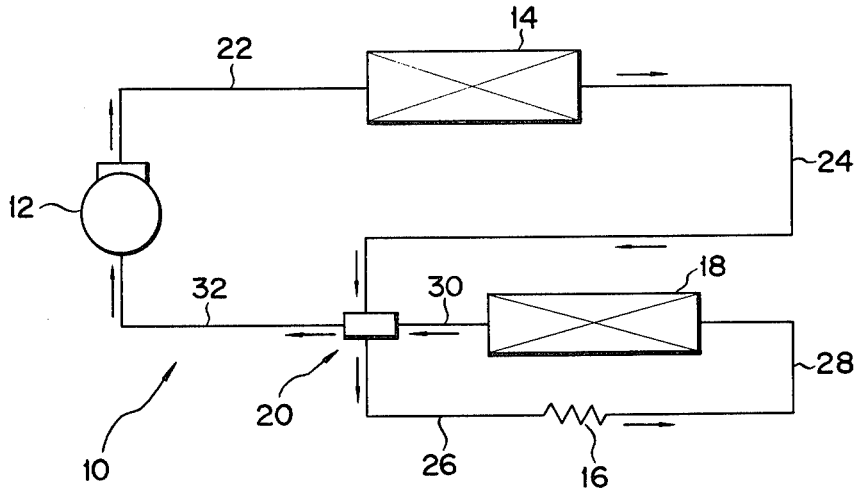

Description will now be given with reference to the accompanying drawings of a refrigeration cycle apparatus embodying this invention. As shown in FIG. 1, the subject refrigeration cycle apparatus 10 comprises a compressor 12, condenser 14, capillary tube 16 acting as a decompressor, evaporator 18 and valve 20 of a pressure responsive type. The suction side of the condenser 14 is connected to the discharge side of the compressor through a coolant pipe 22. The discharge side of the condenser is connected to the valve 20 through a coolant pipe 24. The suction side of the capillary tube 16 is connected to the valve 20 through a coolant pipe 26. The discharge side of the capillary tube 16 is connected to the suction side of the evaporator 18 through a coolant pipe 28. The discharge side of the evaporator 18 is connected to the valve 20 through a coolant pipe 30. The suction side of the compressor 12 is connected to the valve 20 through a coolant pipe 32. The above-mentioned arrangement constitutes a refrigeration cycle in the apparatus of this invention. When the compressor 12 is driven, a coolant runs through the refrigeration cycle system in the direction of the arrows shown in FIG. 1.

Figure 2:
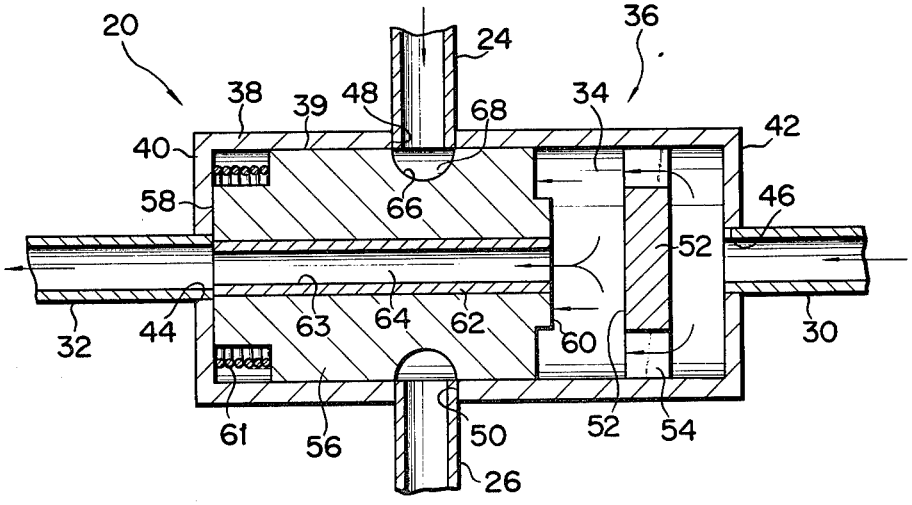
Figure 3:
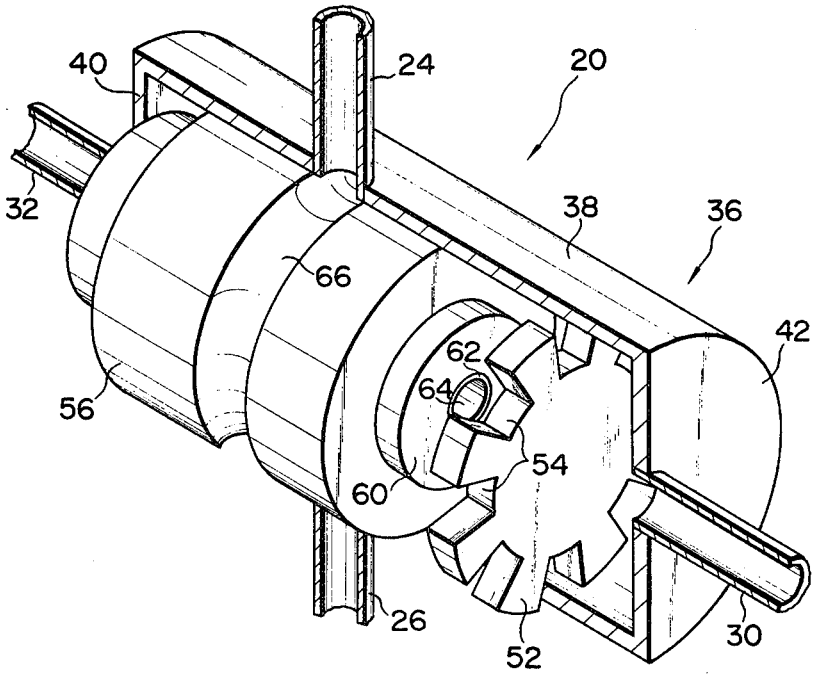

As seen from FIGS. 2 and 3, the valve 20 has a housing 36 in which a chamber 34 is defined. The housing 36 includes a cylindrical body 38, a first circular end plate 40 closing one end of the housing body 38 and a second circular end plate 42 closing the other end of the housing body 38. The chamber 34 is defined by the inner peripheral wall of the cylindrical housing body 38 and the inner walls of the first and second end plates 40, 42. The housing 36 is further provided with a first communication port 44 formed at the center of the first end plate 40 to be opened to the interior of the chamber 34, and a second communication port 46 drilled at the center of the second end plate 42 to be opened to the interior of the chamber 34. Further, the housing 36 is provided with first and second guide ports 48, 50 drilled in the peripheral wall of the cylindrical housing body 38 to be opened to the interior of the chamber 34. The guide ports 48, 50 face each other across the cylindrical body 38. Further, the housing 36 is fitted with a disc-shaped stopper 52 facing the second end plate 42 at a prescribed distance. The peripheral portion of the disc stopper 52 is provided with a plurality of communication ports spatially arranged in the circumferential direction.

The coolant pipe 32 is connected to the first communication port 44. Another coolant pipe 30 is connected to the second communication port 46. As a result, the suction side of the compressor 12 and the discharge side of the evaporator 18 are made to communicate in the chamber 34. The coolant pipe 24 is connected to the first guide port 48. Another coolant pipe 26 is connected to the second guide port 50.

The valve 20 includes a substantially columnar shaped piston 56 set in the chamber 34 between the first end plate 40 and stopper 52. The valve piston 56 has a diameter substantially equal to the inner diameter of the housing body 38, and is made slidable through the housing 36 with the outer peripheral surface of the valve piston 56 brought into contact with the inner peripheral wall of the housing body 38. The outer peripheral surface defines a sliding surface 39. The valve piston 56 has a first operation plane 58 which faces the first end plate 40 and receives the pressure of the suction side of the compressor 12, and a second operation plane 60 which faces the stopper 52 and receives the pressure of the discharge side of the evaporator 18. The outer peripheral portions of the first and second operation planes 58, 60 are each provided with a stepped concave portion. A compression spring 61 of low elasticity is provided between the first end plate 40 and first operation plane 58. The valve piston 56 is urged toward the stopper 52 by the compression spring 61. An insert pipe 62 is forced into the valve piston 56 concentrically therewith. The insert pipe 62 has an inner diameter slightly smaller than the diameter of the communication port 44. Both ends of said insert pipe 62 are respectively open to the first and second operation planes 58, 60 of the valve piston 56. A penetrating hole 63 is defined by the inner wall of the insert pipe 62. The penetrating hole 63 constitutes a first communication passage 64. An annular guide groove 66 is formed in the outer peripheral wall of the valve piston 56 concentrically therewith. This annular guide groove 66 defines the second communication passage 68. The valve piston 56 slides between a first position in which the first operation plane 58 of the valve piston 56 is pressed against the first end plate 40 and a second position in which the second operation plane 60 is pressed against the stopper 52. The first and second guide ports 48, 50 are formed in that portion of the housing body 38 which slidingly contact with the outer peripheral surface of the valve piston 56. When the valve piston 56 takes a first position, the guide groove 66 faces the first and second guide ports 48, 50 as seen from FIG. 2. As a result, the coolant pipes 24, 26 communicate with each other through the second communication passage 68. The coolant pipe 32 communicates with the coolant pipe 30 through the first communication passage 64, chamber 34 and communication hole 54. When the valve piston 56 takes the second position, the first communication passage 64 is closed by the stopper 52 as seen from FIG. 4. In this case, the guide groove 66 is removed from the first and second guide ports 48, 50, which in turn are closed by the outer peripheral surface of the valve piston 56.

Description will now be given of the operation of the subject refrigeration cycle apparatus arranged as described above. When the compressor 12 is driven, a coolant gas is compressed and runs through a refrigeration cycle system in the direction of the arrows shown in FIG. 1. The compressed coolant gas is brought to the condenser 14 where it is condensed into a liquid. Then, the liquid coolant is carried to the capillary tube 16 through the valve 20 to be decompressed by the capillary tube 16. Thereafter, the liquid coolant is volatilized in the evaporator 18. At this time, the coolant absorbs evaporation latent heat from the surrounding atmosphere to effect refrigeration. The volatilized coolant is carried into the compressor 12 through the valve 20. Thereafter, the above-mentioned refrigeration cycle is repeated.

During the operation of the compressor 12, the pressure in the suction side of the compressor 12, that is, the pressure in the coolant pipe 32, is rendered negative to be lower than the pressure of the discharge side of the evaporator 18, namely, the pressure in the coolant pipe 30. As shown in FIG. 2, therefore, the coolant drawn off from the evaporator 18 flows into the chamber 34 through the coolant pipe 30 and communication port 46, and runs through the penetrating hole 54 to press the second operation plane 60 of the valve piston 56. As a result, the valve piston 56 slides toward the first end plate 40 of the housing body 38 against the urging force of the compression spring 61 to be in a first position. When the valve piston 56 is brought to the first position, the second operation plane 60 of the valve piston 56 is removed from the stopper 52 to open the first communication passage 64. Consequently, the coolant which has run into the chamber 34 is conducted through the first communication passage 64 to the coolant pipe 32. When the valve piston 56 slides to the first position, the first and second guide ports 48, 50 communicate with each other through the second communication passage 68. Accordingly, the coolant which has been drawn off from the condenser 14 is carried to the capillary tube 16 through the coolant pipe 24, communication passage 68 and coolant pipe 26 in turn.

Figure 4:
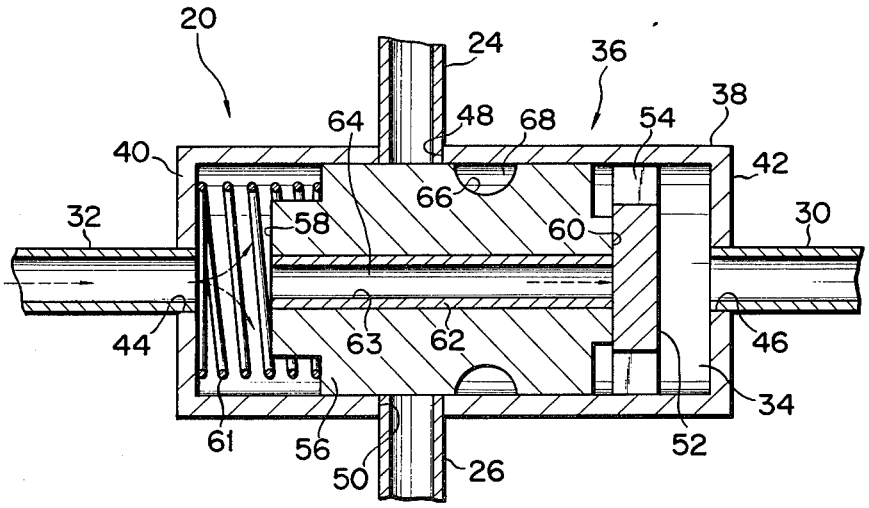

When the compressor 12 stops, the coolant gas in the process of being compressed therein flows back to the coolant pipe 32. As a result, the pressure in the coolant pipe 32 gradually rises to a higher level than that in the coolant pipe 30. The backward flowing coolant gas flows from the first communication port 44 to the chamber 34 to press the first operation plane of the valve piston 56. Consequently, the valve piston 56 slides as shown in FIG. 4 by the pressure of the backward-flowing coolant gas and the urging force of the compression spring 61, until the second operation plane 60 of the valve piston 56 slides to the second position. In about 5 to 60 seconds after the stopping of the compressor 12, the valve piston 56 slides to the second position. At this time, the first communication passage 64 is closed by the stopper 52, thereby shutting off communication between the suction side of the compressor 12 and the discharge side of the evaporator 18. Consequently, the coolant gas is prevented from making flowing backward any further. The guide groove 66 is removed from the first and second guide ports 48, 50, which in turn are closed by the outer peripheral wall of the valve piston 56. As a result, communication between the discharge side of the condenser 14 and the suction side of the capillary tube 16 is shut off, thereby obstructing the flow of the coolant.

As described above, when the compressor 12 stops, the valve 20 has a double function of acting as a stop valve for preventing the back-flow of the coolant from the compressor 12 to the evaporator and also acting as an electromagnetic valve for stopping the flow of the coolant collected in the condenser 14 to the evaporator 18. Therefore, the refrigeration cycle apparatus 10 serves these purposes simply by applying a single valve in place of the stop valve and electromagnetic valve used with the conventional refrigeration cycle apparatus, and consequently, can be manufactured at low cost. Unlike the electromagnetic valve, the valve used in this invention is actuated by a pressure difference between the suction side of the compressor and the discharge side of the evaporator 18. Therefore, it is unnecessary to use an electric circuit and electric power for the actuation of the valve 20, thereby assuring the inexpensive manufacture of the refrigeration cycle apparatus 10 of this invention and a reduction in the power consumption of the apparatus 10.

Figure 5:
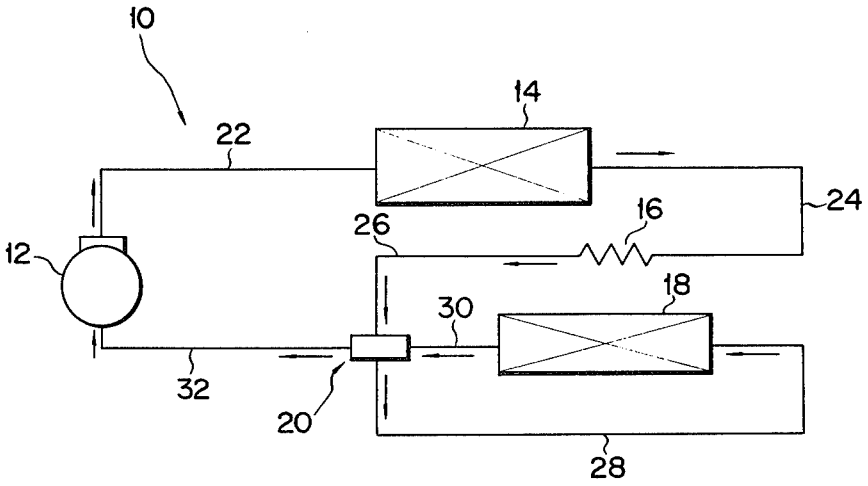
FIGS. 5 and 6 are block circuit diagrams of the refrigeration cycles performed by the different modifications of the refrigeration cycle apparatus of the invention.
Figure 6:
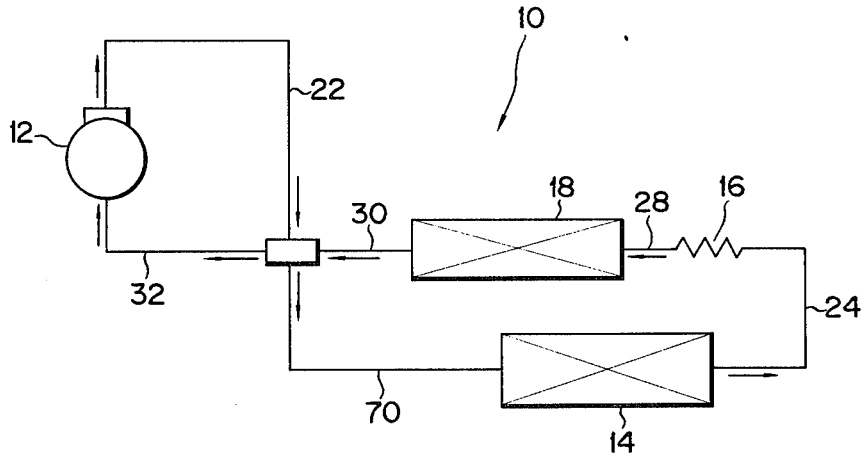

It will be noted that the invention is not limited to the above-mentioned embodiment. In this embodiment, the first and second guide ports 48, 50 were designed to effect communication between the coolant pipes 24, 26. However, this arrangement need not be exclusively followed. The first and second guide ports need only be connected between the discharge side of the compressor 12 and the suction side of the evaporator 18. It is possible, as shown in FIG. 5, to connect the discharge side of the capillary tube 16 to the first guide port 48 through the coolant pipe 26, and to connect the suction side of the evaporator 18 to the second guide port 50 through the coolant pipe 28. It is also possible, as shown in FIG. 6, to connect the discharge side of the compressor 12 to the first guide port 48 through the coolant pipe 22 and to connect the suction side of the condenser 14 to the second guide port 50 through the coolant pipe 70. The above-mentioned two modifications in which the valve 20 has the same arrangement as the aforementioned embodiment assures the same effect as said embodiment.

The housing body 38 and valve piston 56 need not be shaped like a round cylinder or column, but may be made in the form of an angular or square column. The compression spring 61 is not always a requirement. The valve piston 56 can be fully driven by a pressure difference between the suction side of the compressor 12 and the discharge side of the evaporator 18. However, the provision of the compression spring 61 has the advantage of accelerating the movement of the valve piston 56. If the second communication port 46 is formed in the outer peripheral portion of the second end plate 42 of the housing 36, the stopper 52 can be omitted. In the foregoing embodiment, the second communication passage 68 was defined by the guide groove 66. However, the second communication passage may be defined by a through hole formed, for example, in the valve piston 56. Moreover, the insert pipe 62 may have an inner diameter slightly larger than the diameter of the communication port 44.

What is claimed is:

1. A refrigeration cycle apparatus which comprises:
a compressor;
a condenser connected to the discharge side of the compressor;
an evaporator connected to the suction side of the compressor;
a decompressor connected between the condenser and evaporator; and
a valve which includes a housing having a chamber communicating with the suction side of the compressor and the discharge side of the evaporator and first and second guide ports open to the interior of the chamber, and
a valve piston slidably received in the chamber and provided with a first operation plane receiving the pressure of the suction side of the compressor, a second operation plane receiving the pressure of the discharge side of the evaporator, a first communication passage for effecting communication between the suction side of the compressor and the discharge side of the evaporator and a second communication passage for effecting communication between the first and second guide ports, the valve, when the suction side of the compressor has a lower pressure than the discharge side of the evaporator, sliding to a first position in which the suction side of the compressor communicates with the discharge side of the evaporator through the first communication passage and the first guide port communicates with the second guide port through the second communication passage; and the valve, when the suction side of the compressor has a higher pressure than the discharge side of the evaporator, sliding to a second position in which communication between the suction side of the compressor and the discharge side of the evaporator as well as between the first and second guide ports are shut off; and wherein the first and second guide ports are connected between the discharge side of the compressor and the suction side of the evaporator.

2. The refrigeration cycle apparatus according to claim 1, wherein said housing comprises a cylindrical body in which the first and second guide ports are formed, a first end plate which closes one end of the cylindrical body and is provided with a first communication port connected to the suction side of the compressor, and a second end plate which closes the other end of the cylindrical body and is provided with a second communication port connected to the discharge side of the evaporator; and the chamber is defined by the inner wall of the cylindrical body and the inner walls of the first and second end plates.

3. The refrigeration cycle apparatus according to claim 2, wherein said valve piston includes a sliding surface which slides over the inner wall of the cylindrical body and closes the first and second guide ports when the valve piston occupies a second position; the first operating plane faces the first end plate; and the second operating plane faces the first end plate.

4. The refrigeration cycle apparatus according to claim 3, wherein said cylindrical body is shaped in a round cylindrical form, and the valve piston is shaped in a round columnar form whose diameter is made substantially equal to the inner diameter of the cylindrical body, and is so set that the outer peripheral wall of the valve piston can slide over the inner peripheral wall of the cylindrical body.

5. The refrigeration cycle apparatus according to claim 4, wherein said first and second guide ports are made to face each other across the cylindrical body; and the valve piston includes a penetrating hole which is formed in the valve piston, both ends of which are open to the first and second operating planes to define the first communication passage, and an annular guide groove which is formed in the outer peripheral wall of the valve piston to define the second communication passage, the guide groove facing the first and second guide ports, when the valve piston assumes the first position.

6. The refrigeration cycle apparatus according to claim 5, wherein said penetrating hole is concentrically formed with the valve piston; the first and second communication ports face both ends of the penetrating hole; the housing comprises a disc stopper which is set in the chamber apart from the second end plate to face the second operating plane and whose outer peripheral portion is provided with a plurality of communication holes; and when the valve piston occupies the first position, the first operating plane is pressed against the first end plate of the housing, and when the valve piston occupies the second position, the second operating plane is pressed against the stopper, which in turn closes the penetrating hole of the valve piston.

7. The refrigeration cycle apparatus according to claim 6, wherein said valve is provided with an urging member which is set between the first end plate and the first operating plane to urge the valve piston toward the stopper.

8. The refrigeration cycle apparatus according to claim 1, wherein the discharge side of the condenser is connected to the first guide port, and the suction side of the decompressor is connected to the second guide port.

9. The refrigeration cycle apparatus according to claim 1, wherein the discharge side of the decompressor is connected to the first guide port; and the suction side of the evaporator is connected to the second guide port.

10. The refrigeration cycle apparatus according to claim 1, wherein the discharge side of the compressor is connected to the first guide port; and the suction side of the condenser is connected to the second guide port.

* * * * *